US006204824B1

(12) United States Patent
Davi et al.

(10) Patent No.: US 6,204,824 B1
(45) Date of Patent: Mar. 20, 2001

(54) COLLAPSIBLE FOLDED DIPOLE ANTENNA

(75) Inventors: Leonard A. Davi, Lake Mary; Harvey E. Gilbert, Altamonte Springs, both of FL (US)

(73) Assignee: Recoton Corporation, Lake Mary, FL (US)

( * ) Notice: Subject to any disclaimer, the term of this patent is extended or adjusted under 35 U.S.C. 154(b) by 0 days.

(21) Appl. No.: 09/158,051

(22) Filed: Sep. 22, 1998

(51) Int. Cl.[7] ..... H01Q 1/08; H01Q 9/26
(52) U.S. Cl. ..... 343/803; 343/805; 343/881
(58) Field of Search ..... 343/803, 805, 343/880–882; H01Q 9/26, 9/44, 1/08

(56) References Cited

U.S. PATENT DOCUMENTS 3,290,689 * 12/1966 Rieth ..... 343/803
5,886,669 * 3/1999 Kita ..... 343/803
5,892,484 * 4/1999 MacGahan ..... 343/803

* cited by examiner

*Primary Examiner*—Michael C. Wimer
(74) *Attorney, Agent, or Firm*—Levisohn, Lerner, Berger and Langsam

(57) ABSTRACT

A collapsible antenna is provided; it is preferably a folded dipole antenna. The antenna has a main body section and two arm sections attached to the main body. At least one of the arms may be moved from an extended position to a collapsed position, thereby reducing the overall length of the antenna. Preferably, the arms may be rotated or pivoted from a first expanded configuration in which they extend in opposite directions from one another to a second collapsed configuration in which they subtend an angle substantially less than 180°. Preferably, the arms extend from the body section in substantially the same direction when they are in the collapsed configuration. A locking mechanism selectively secures the arms in both configurations. Alternatively, one or both arms may telescope. The invention also includes mutual inductance cancelling coils for further reducing the overall length of the antenna without reducing the effective length of the antenna.

22 Claims, 8 Drawing Sheets

COLLAPSIBLE FOLDED DIPOLE ANTENNA

BACKGROUND OF THE INVENTION

1. Field of the Invention

This invention relates to antennas for receiving transmitted signals, and more particularly to folded dipole antennas.

2. Description of the Related Art

In order for televisions and radios to receive transmissions, they must be equipped with antennas. One such type of antenna is known in the art as a "folded dipole" antenna. A conventional folded dipole antenna is shown in wire schematic form in FIG. 1. FIG. 1 shows the direction of current flow in a conventional folded dipole. Conventionally, the overall length of a folded dipole is dimensioned equal to ½ the wavelength of a signal it is intended to receive. Thus, if a signal has a frequency of approximately 72 MHz (i.e., TV channel 4) and has a wavelength of approximately 4.0 m, the folded dipole would optimally be approximately 2.0 m in length. One such conventional folded dipole antenna is the TERK TV-50, the teaching of which is hereby incorporated by reference. Smaller antennas are available for FM radio reception, for example, the TERK-FM antenna, the teaching of which is herein incorporated by reference.

The above conventional folded dipole antenna suffers from several drawbacks. Primarily, because it is typically made as a single solid piece, it is very cumbersome. For example, the TERK TV-50 antenna is 76 inches long. As a result of this great size, the conventional folded dipole is difficult to carry, difficult to mount, and difficult to install. Further, from a manufacturing and sales perspective, the conventional device is difficult to store, difficult to transport, difficult to package, and difficult to display. Its height and width are typically not large, however its length is problematic at best.

Accordingly, it is an object of the invention to provide a folded dipole antenna that is not as cumbersome as conventional folded dipole antennas.

It is another object of the invention to provide a folded dipole antenna that is easy to carry, mount, install, store, transport, package, and display.

SUMMARY OF THE INVENTION

The above and other objects are achieved by the invention, which is an antenna for receiving electromagnetic signals, having a body section housing electronic components and at least two arm sections housing a folded dipole conductor. The arm sections are attached to the body section and the folded dipole conductor is electrically connected to the electronic components. The arm sections are preferably disposed on opposite sides of the body section. At least one of the arm sections is movable between a first extended position and a second collapsed position; an overall length of the antenna is smaller when the movable arm section is in the second collapsed position as compared to the first extended position.

In a preferred embodiment, the antenna has a body section, housing electronic components, the body section having hinged portions, and at least two arm sections housing a conductor, hingedly attached and electrically connected to the body section at the hinged portions, disposed on opposite sides of the body section. The arm sections pivot about the hinged portions and are movable between a first extended position in which the arm sections extend from the body in substantially opposite directions to a second collapsed position in which the arm sections extend from the body section subtending an angle of substantially less than 180°. Preferably, the arm sections extend from the body section in substantially the same direction when in the second collapsed position. The antenna is preferably a folded dipole antenna.

A wire conductor is provided in the arm sections and is electrically connected to the body section. The wire has a section that is external to both the arm and body sections; that is, the wire conductor passes along the arm section, passes out of one or more holes in the arm section external to the antenna, and enters the body section to be electrically connected therein. Preferably, the external section of the wire conductor is provided with slack so that the arm sections may be freely moved from the first extended position to the second collapsed position with ease and without putting strain on the conductor.

Preferably, the antenna includes a locking mechanism for securing the arms in the extended or collapsed positions. The locking mechanism is preferably structured as follows. Each of the hinged portions has a hub fixedly attached to the body section and a bore formed in each of the arm sections. The hub is disposed in the bore. The locking mechanism includes at least one protuberance or ridge disposed on either the hubs or the inner walls of the bores and at least two indentations or grooves formed in the other of the inner walls of the bores and the hubs, the protuberance being selectively engageable in the indentations. When the protuberance is engaged in a first indentation, the arm section is secured in the first position, and when the protuberance is engaged in a second indentation, the arm section is secured in the second position. Alternatively, one indentation and two protuberances may be employed.

Preferably, the antenna has mutual inductance cancelling coils disposed at opposite ends of the folded dipole for the purpose of further reducing the length of the VHF element of the antenna. Additionally, the antenna is preferably provided with a UHF element including a printed circuit board having a printed UHF element and an amplifier.

DETAILED DESCRIPTION OF THE PREFERRED EMBODIMENT

Figure 1:
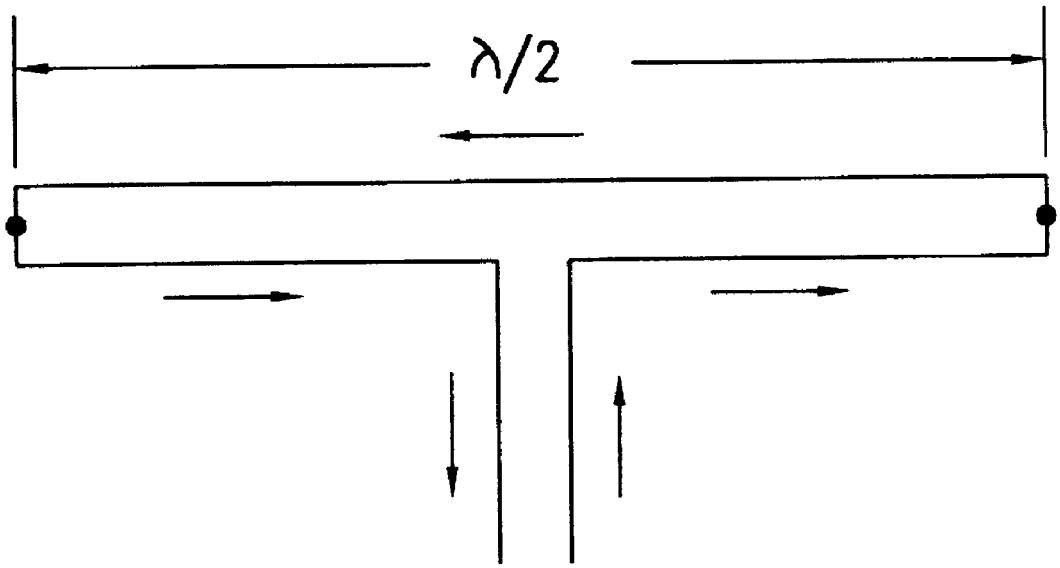
FIG. 1 (PRIOR ART)
FIG. 1 is a basic schematic of a conventional folded dipole antenna showing the direction of current flow.

A description of the invention will now be given with reference to FIGS. 2–7. A basic wire diagram of the invention is shown in FIG. 6. As shown in FIG. 6, antenna 20, preferably a folded dipole, includes wire sections 12 and mutual inductance cancelling coils 10 at either end of the folded dipole. Wire sections 12 form the VHF element of the antenna. The provision of a coil in the wire serves to simulate a longer length of wire, however the provision of a single coil would result in undesired inductance. By providing pairs of coils 10, one coil of a pair being wound in the opposite direction of the other of the pair, the inductance created by one coil cancels out the inductance created by the other coil. In this way, the overall length of the antenna is reduced without reducing the electrical length of the wire.

The VHF element of the antenna is attached to printed circuit board 26. In order to reduce the size of the antenna further, a printed circuit board is employed for the UHF component. Printed circuit board 26 is provided with a printed UHF element 16 and an amplifier 18. UHF element 16 assists in receiving transmissions in the UHF band, and amplifier IS boosts all signals that are received, be they UHF or VHF. Antenna 20 is connected to a receiver via cable connector 19.

Figures 2A, 2B, 2C:
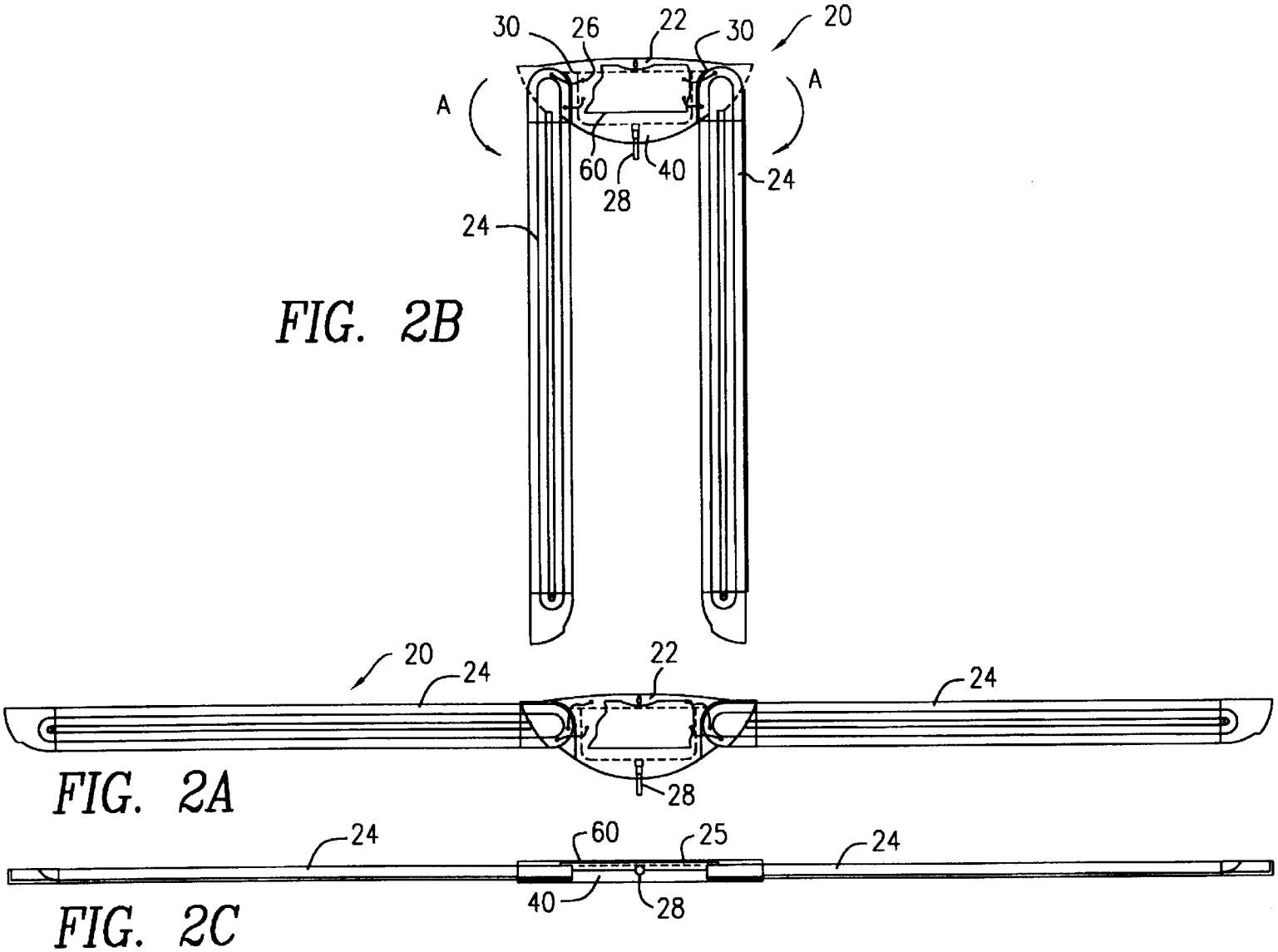
FIG. 2A is a top plan view of a collapsible folded dipole antenna according to the present invention in its extended configuration.
FIG. 2B is a top plan view of a collapsible folded dipole antenna according to the present invention in its collapsed configuration with the top half of the housing partially broken away at the sides.
FIG. 2C is a front view of the antenna of FIG. 2A.

A simple overview of the invention is illustrated in FIGS. 2A–C. Antenna 20 includes a main body 22 and projecting arms 24. The folded dipole VHF element 12 of FIG. 6 is disposed in arms 24, and printed circuit board 26 (shown in dotted lines in FIG. 2) preferably includes UHF element 16 and amplifier 18. Arms 24 are hingedly attached to main body 22 in a manner to be described below. Arms 24 are also electrically connected to main body 22 via wire sections 30. More specifically, the long VHF element 12 disposed inside arms 24 exits arms 24 via two small holes in arms 24 and enters main body 22 via two small holes in the main body to hook up with printed circuit board 26. Arms 24 are movable from a fully extended position as shown in FIG. 2A to a collapsed position as shown in FIG. 2B. The arms are pivoted from their oppositely extending positions in FIG. 2A along arrows A (see FIG. 2B) to their positions in FIG. 2B. The external wire section 30 of the VHF element 12 is provided with sufficient slack so that arms 24 may move freely between the two positions without putting a strain or tension on VHF element 12.

Main body 22 includes front housing 60 and back or rear housing 40, both of which will be described in greater detail below. As best illustrated in FIG. 2C, front housing 60 partially covers the proximal ends of arms 24 so that external wire sections 30 are covered and protected.

With the above configuration of a collapsible folded dipole antenna, the antenna may be reduced in overall length by up to 50%. As a result, it is easier to carry, mount, install, store, transport, package, and display than conventional folded dipole antennas, since a reduced size configuration is available for the antenna. The antenna according to the present invention has the advantages of decreased packaging costs, decreased shipping costs, and increased storage density in a warehouse or a department store display. The collapsed antenna depicted in FIG. 2B is shown having arm sections extending in substantially the same direction, i.e., subtending an angle of 0°; this is the preferred embodiment of the collapsed configuration. However, as long as the arm sections in the second collapsed configuration subtend any angle less than 180°, the overall length of the antenna is reduced.

Figure 3A:
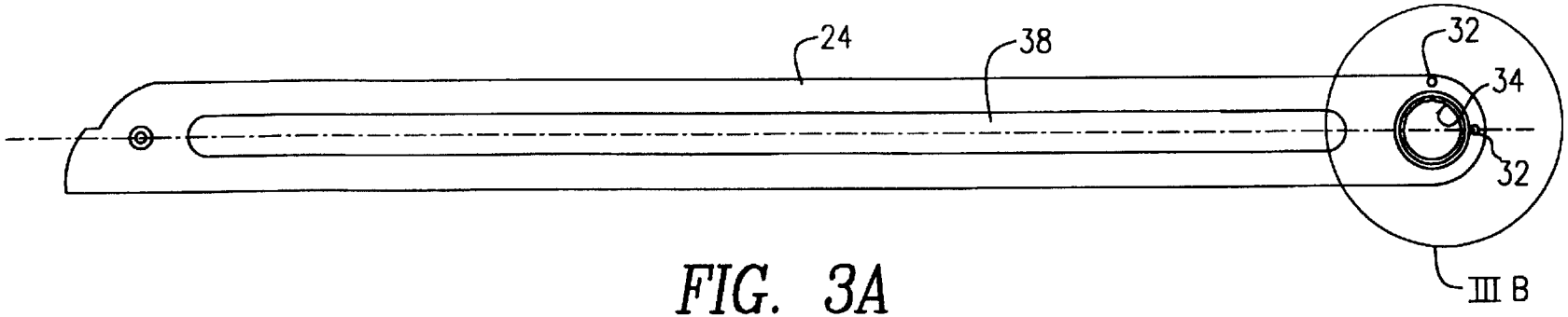
FIG. 3A is a top plan view of an arm section of a collapsible folded dipole antenna according to the present invention.
Figure 3C:
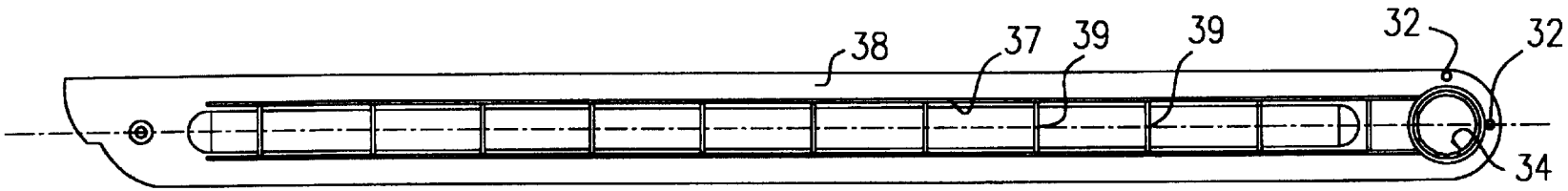
FIG. 3C is an underside view of the top half of the arm section of FIG. 3A.
Figure 3B:
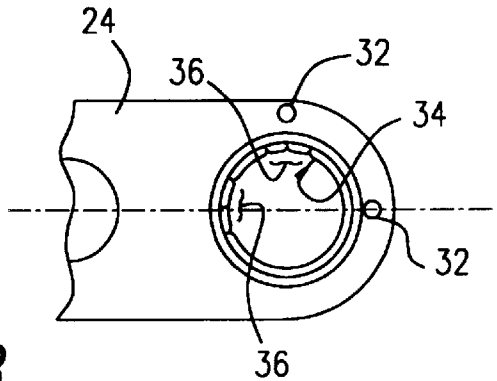
FIG. 3B is a magnified detail view of portion IIIB of FIG. 3A.
Figure 4A:
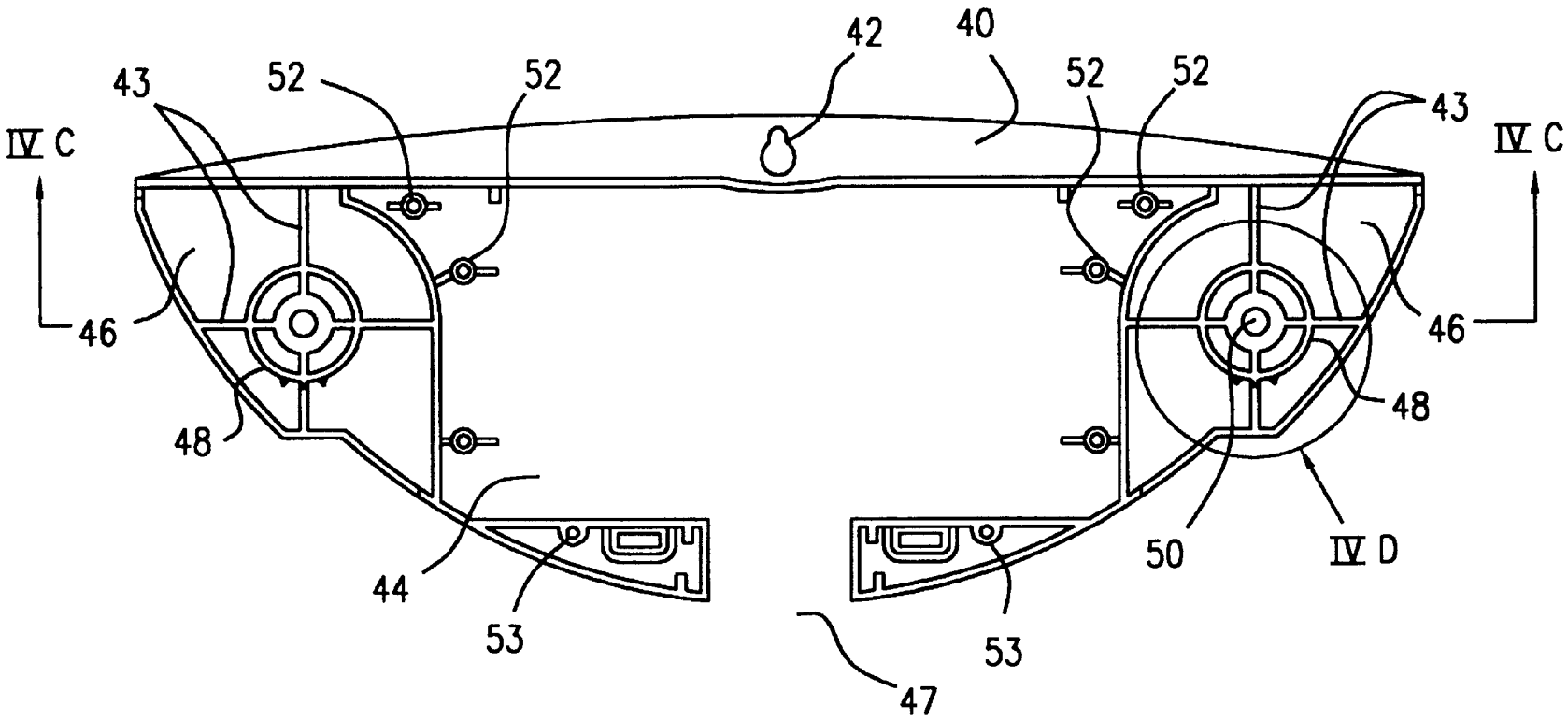
FIG. 4A is a top plan view of the bottom half of the main section of a collapsible folded dipole antenna according to the present invention.
Figure 4B:
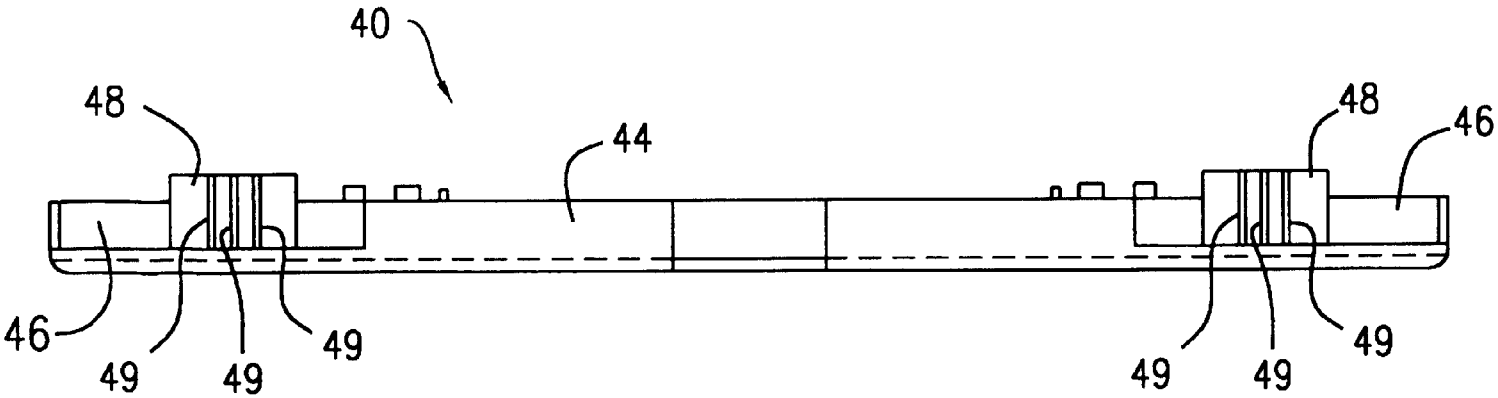
FIG. 4B is a front view of the bottom half of the main section of FIG. 4A.
Figure 4C:
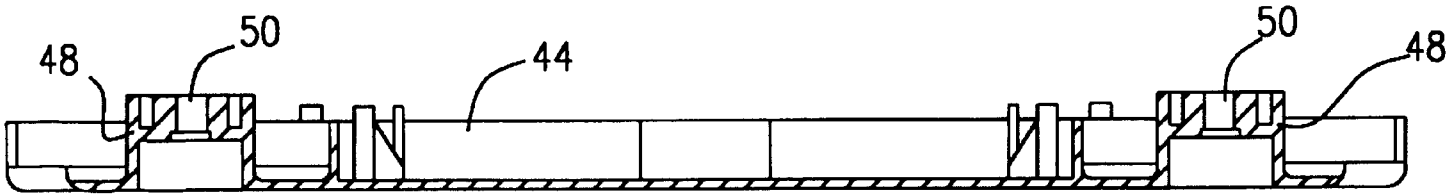
FIG. 4C is a sectional view of the bottom half of the main section of FIGS. 4A–B.

Arm 24 is best illustrated in FIGS. 3A–C. FIG. 3A is a front plan view of the arm without its constituent electronic components, and FIG. 3C is an underside view of the front half of the housing of arm 24; the rear half is preferably substantially identical to the front half, and both arms are substantially identical. Arm 24 is provided with a central support channel 38 which adds to the structural integrity of the arm. As best seen in FIG. 3C, support channel 38 preferably includes longitudinal ribs 37 and cross ribs 39 for strength. Holes 32 are provided so that the VHF wire element 12 contained in the arm can be connected to the main body 22 as discussed above. Wire element 12 passes around central support channel 38 and through holes 32 to be connected to main body 22.

Arm 24 is provided at its distal end with through-hole 34. A hub on the main body 22 passes through through-hole 34 and allows arm 24 to be hinged or rotated in the direction of arrow A of FIG. 2B. As best illustrated in FIG. 3B, provided on the inner wall of through-hole 34 are indentations or grooves 36 in at least two groupings. Grooves 36 form part of a locking mechanism which secures arm 24 in one of at least two positions, e.g., the two positions shown in FIGS. 2A and B. The remainder of the locking mechanism will be described below.

The main body 22 of the preferred embodiment of the invention is shown in FIGS. 4–5. FIGS. 4A–D depict the rear housing 40 in front, bottom, and sectional views. In a central location is disposed mounting hole 42 for allowing the antenna 20 to be mounted by a nail, screw, or similar mounting device. The central portion of the rear housing 40 is flat and forms a recess 44 into which the PCB 26 is disposed. Slots 52 allow the external section 30 of wire element 12 to enter main body 22 and electrically connect with PCB 26. In a central location opposite the mounting hole 42 is provided opening 47. Opening 47 allows cable to connect the antenna 20 to a signal receiver such as a television or to a VCR.

On opposite sides of rear housing 40 are provided landings 46 which support and receive the proximal ends of arms 24. Centrally disposed in landings 46 are hubs 48 which pass through through-holes 34 of arms 24. Support ribs 43 extend radially outward from hub 48 to provide structural integrity to landing 46. A bore 50 is formed substantially central to hub 48 through which a screw, pin, or rivet (not shown) may pass for securing the rear housing 40 to the arm but still allowing arm 24 to rotate about hub 48. Landings 46, hubs 48, and the distal ends of arms 24 are so dimensioned as to allow unobstructed rotation of arms 24 around hubs 48 as shown in FIGS. 2A–B. However, it is desirable to be able to selectively secure the arms in a fixed position, either extended as in FIG. 2A for use as an antenna or collapsed as in FIG. 2B for storage, shipping, or the like. To this end, protuberances or ridges 49 are formed on the outside wall of hub 48. These ridges 49 are dimensioned to cooperate with grooves 36 on the inner wall of through-hole 34 of arm 24.

Figure 5A:
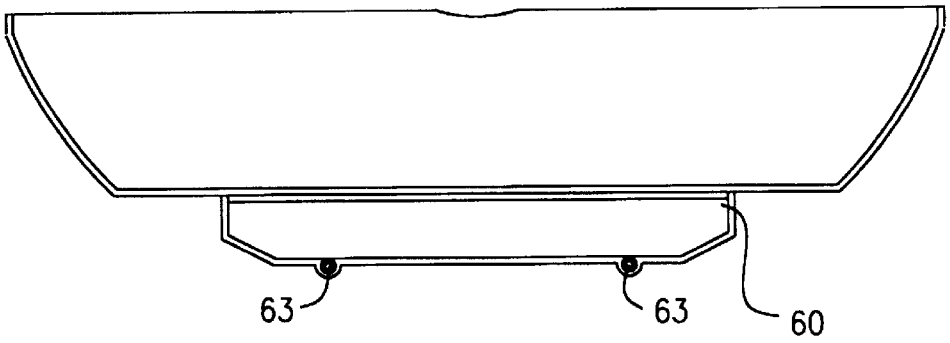
FIG. 5A is a top plan view of the top half of the main section of a collapsible folded dipole antenna according to the present invention.
Figure 5B:
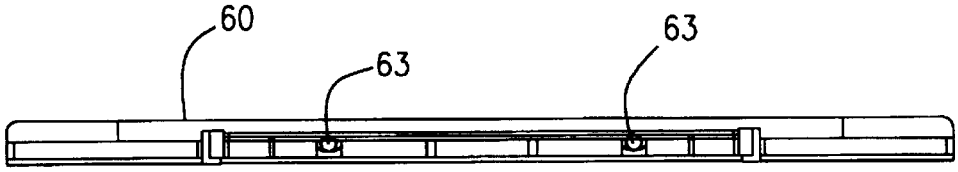
FIG. 5B is a front view of the top half of the main section of FIG. 5A.
Figure 4D:
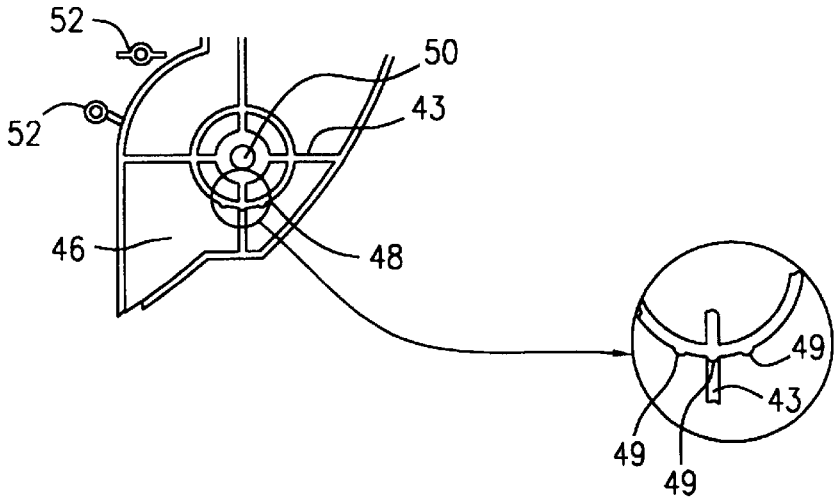
FIG. 4D is a magnified detail view of portion IVD of FIG. 4A.
Figure 6:
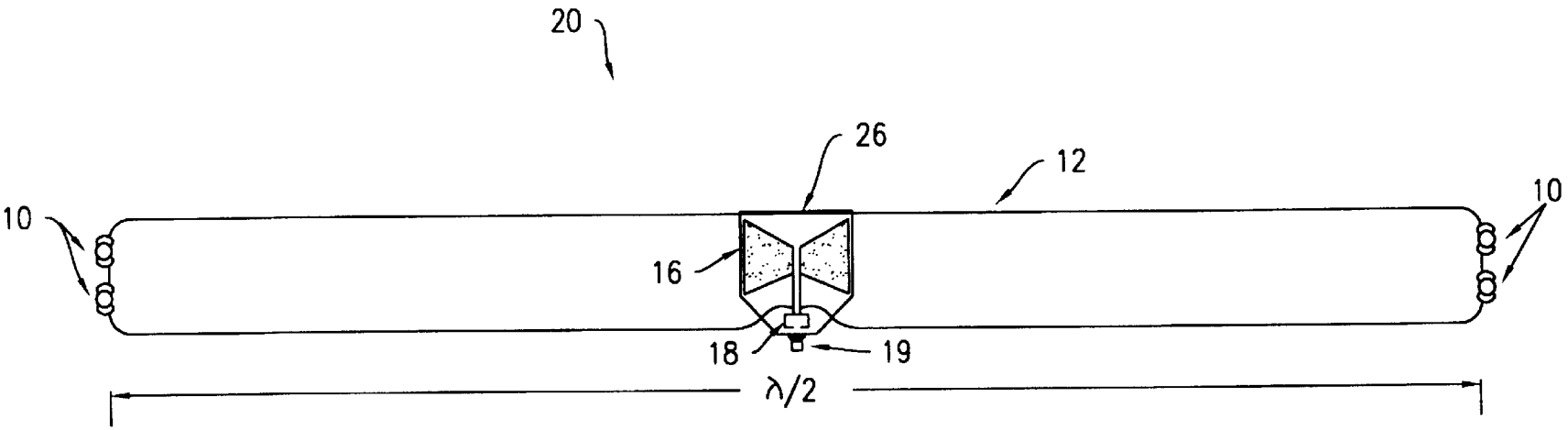
FIG. 6 is a basic wiring diagram of a folded dipole antenna according to the present invention.

Rear housing 40 may be provided with threaded holes 53 designed to receive screws (not shown); threaded holes 53 matingly align with holes 63 formed on upper housing 60 (see FIGS. 5A–B). In this manner the front and rear housings of main body 22 may be secured together.

The invention operates as follows. The purchaser receives the antenna in its packaging, preferably with the antenna configured as shown in FIG. 2B, i.e., in its collapsed configuration. Ridges 49 are secured in one set of grooves 36 so as to maintain arms 24 in this collapsed configuration. The user then mounts the antenna, for example, on the outside of his house. Once the antenna is mounted, the user overcomes the securing force of the ridges/grooves interaction (which is preferably sufficient to secure the arms in place but not so strong that a person could not manually apply enough torque to overcome it) and rotates the arms opposite to the direction of arrows A in FIG. 2B. Ridges 49 on hub 48 are secured in the other set of grooves 36 corresponding to the open or extended configuration of the antenna, as shown in FIG. 2A.

Having described the invention with respect to the attached drawings and the preferred embodiment, it is to be understood that the invention is not so limited. Rather, the invention is defined by the claims appearing hereinbelow, and modifications to the above description are well within the scope of the contemplated invention. For example, the amplifier described as part of the printed circuit board is optional. Preferably, the antenna is approximately 1.5 meters long, fully extended, if it is to be used for receiving television signals. However, other lengths are equally preferable if the antenna is to be used for receiving other types of signals such as FM radio transmissions.

Also, the locking mechanism described above utilizes one set of ridges 49 disposed on the outside of hub 48 and two sets of grooves 36 disposed on the inside of through-hole 34. In the alternative, the ridges may be disposed on the inner wall of the through-hole of the arm and the grooves may be disposed on the hub. In another alternative, instead of providing one set of ridges and two sets of grooves, as described above, the invention may utilize two sets of ridges and one set of grooves. Again, the ridges may be disposed on either the inner wall of the through-hole or on the outside of the hub. It is also within the scope of the invention to provide more than two sets of grooves or ridges so as to allow the arms of the antenna to be fixed in a multiplicity of positions, i.e., positions angularly between those of FIGS. 2A and B. The arms may be independently movable with respect to the main body, thus allowing for an even greater number of overall configurations (e.g., one arm fully extended and the other arm at 45°, one arm at 30° and the other at 60°, etc.).

Figure 7A:
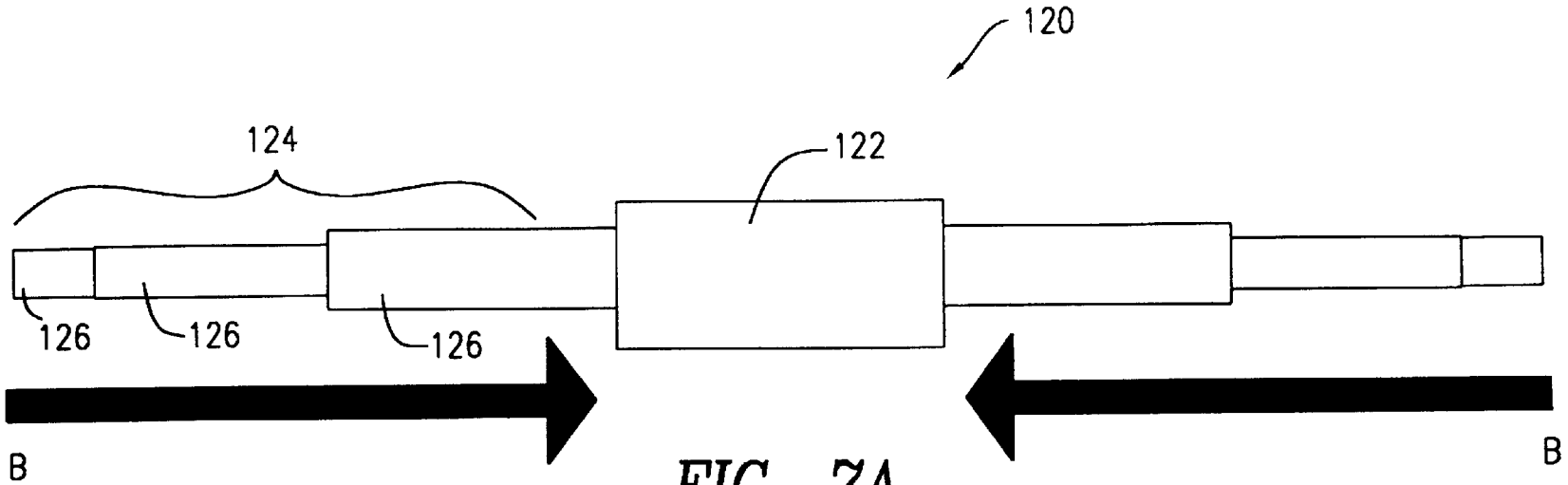
FIG. 7A is a top plan schematic of an alternative embodiment of the invention in an expanded configuration.
Figure 7B:
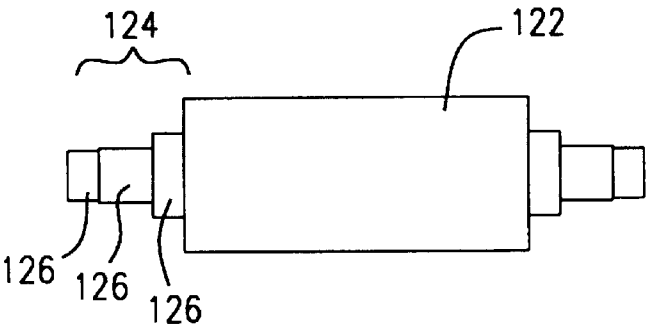
FIG. 7B is a top plan schematic of an alternative embodiment of the invention in a collapsed configuration.

The specification mainly calls for an antenna with hinged, pivoting, or rotating arms. However, other methods of collapsing the inventive folded dipole antenna are also contemplated. For example, it is contemplated as being within the scope of the invention to provide a folded dipole antenna with at least one arm section moving in a telescoping fashion from a first extended position to a second collapsed position. Preferably, both arm sections would be telescoping from an extended to a collapsed position so as to significantly reduce the overall length of the device and greatly facilitate shipping, packaging, and the like. This alternative embodiment is shown in FIGS. 7A–B. Antenna 120 is provided with a main section 122 and telescoping arms 124. Arms 124 include one or more nested telescoping sections 126 which fit inside one another. Arms 124 may be collapsed into the smaller configuration of FIG. 7B from the expanded position of FIG. 7A by pushing the arms inwards in the directions of arrows B, respectively. While telescoping antennas may be known, this alternative embodiment is novel in that no folded dipole antenna has ever been made collapsible.

We claim:

1. An antenna for receiving electromagnetic signals, comprising:

a body section, housing electronic components, said body section having hinged portions; and at least two arm sections hingedly attached to said body section at said hinged portions, said arm sections housing a conductor electrically connected to said electronic components, said arm sections disposed on opposite sides of said body section, each of said hinged portions including a hub fixedly attached to said body section and a bore formed in each of said arm sections, said hub disposed in said bore, wherein said arm sections pivot about said hinged portions and are movable between a first position in which said arm sections extend from said body section in substantially opposite directions to a second position in which said arm sections extend from said body section subtending an angle less than 180°, and wherein said hinged portions further comprise locking means for locking respective said arm sections in said first and second positions, said locking means comprises:

at least one protuberance disposed on one of said hub and an inner wall of each of said bores; and at least two indentations formed in the other of said hub and said inner wall of each of said bores, said protuberance selectively engageable in said indentations, wherein when said protuberance is engaged in a first indentation, said arm section is secured in said first position, and when said protuberance is engaged in a second indentation, said arm section is secured in said second position.

2. An antenna according to claim 1, wherein said conductor comprises a folded dipole.

3. An antenna according to claim 1, wherein an overall length of said antenna when said arm sections are in said first position is approximately ½ of an electrical wavelength of a predetermined signal.

4. An antenna according to claim 3, wherein said predetermined signal is a television signal.

5. An antenna according to claim 1, wherein said arm sections are substantially coplanar in both said first and second positions.

6. An antenna according to claim 1, wherein said conductor is electrically connected to said electronic components in said body section.

7. An antenna according to claim 6, wherein said conductor comprises a wire exiting said arm section via two holes and being connected to said body section, said wire having a wire section external to both said arm section and said body section, said wire section being provided with slack when said arm section is in either of said first and second positions.

8. An antenna according to claim 1, wherein a first overall length of said antenna when said arm sections are in said first position is approximately twice as long as a second overall length of said antenna when said arm sections are in said second position.

9. An antenna according to claim 1, wherein said arm sections may be independently pivoted about respective said hinged portions.

10. An antenna according to claim 3, wherein said predetermined signal is an FM radio signal.

11. An antenna according to claim 1, wherein said arm sections extend from said body section in substantially the same direction when in said second position.

12. An antenna for receiving electromagnetic signals, comprising:

a body section, housing electronic components, said body section having hinged portions; and at least two arm sections hingedly attached to said body section at said hinged portions, said arm sections housing a conductor electrically connected to said electronic components, said arm sections disposed on opposite sides of said body section, each of said hinged portions including a hub fixedly attached to said body section and a bore formed in each of said arm sections, said hub disposed in said bore, wherein said arm sections pivot about said hinged portions and are movable between a first position in which said arm sections extend from said body section in substantially opposite directions to a second position in which said arm sections extend from said body section subtending an anole less than 180°, and wherein said hinged portions further comprise locking means for locking respective said arm sections in said first and second positions, said locking means comprises:

at least one indentation formed in one of said hub and an inner wall of each of said bores; and at least two protuberances formed on the other of said hub and said inner wall of each of said bores, said indentation selectively engageable with said protuberances, wherein when a first protuberance is engaged in said indentation, said arm section is secured in said first position, and when a second protuberance is engaged in said indentation, said arm section is secured in said second position.

13. A folded dipole antenna comprising:

a body section, housing electronic components, said body section having hinged portions; and at least two arm sections housing a folded dipole conductor, said arm sections hingedly attached to said body section at said hinged portions, said folded dipole conductor electrically connected to said electronic components, said arm sections disposed on opposite sides of said body section, wherein each of said hinged portions includes a hub fixedly attached to said body section and a bore formed in each of said arm sections, said hub disposed in said bore, wherein said arm sections pivot about said hinged portions and are movable between a first position in which said arm sections extend from said body section in substantially opposite directions to a second position in which said arm sections extend from said body section in substantially the same direction, and wherein said hinged portions further comprise locking means for locking respective said arm sections in said first and second positions, said locking means comprising:

at least one protuberance disposed on one of said hub and an inner wall of each of said bores; and at least two indentations formed in the other of said hub and said inner wall of each of said bores, said protuberance selectively engageable in said indentations, wherein when said protuberance is enraged in a first indentation, said arm section is secured in said first position, and when said protuberance is engaged in a second indentation, said arm section is secured in said second position.

14. A folded dipole antenna according to claim 13, wherein an overall length of said antenna when said arm sections are in said first position is approximately ½ of an electrical wavelength of a predetermined signal.

15. A folded dipole antenna according to claim 14, wherein said predetermined signal is a television signal.

16. A folded dipole antenna according to claim 13, wherein said arm sections are substantially coplanar in both said first and second positions.

17. A folded dipole antenna according to claim 13, wherein said folded dipole conductor comprises a wire exiting said arm section via two holes and being connected to said body section, said wire having a wire section external to both said arm section and said body section, said wire section being provided with slack when said arm section is in both first and second positions.

18. A folded dipole antenna according to claim 13, wherein a first overall length of said antenna when said arm sections are in said first position is approximately twice as long as a second overall length of said antenna when said arm sections are in said second position.

19. A folded dipole antenna according to claim 13, wherein said arm sections may be independently pivoted about respective said hinged portions.

20. A folded dipole antenna according to claim 14, wherein said predetermined signal is an FM radio signal.

21. A folded dipole antenna according to claim 13, wherein said arm sections extend from said body section in substantially the same direction when in said second position.

22. A folded dipole antenna comprising:

a body section, housing electronic components, said body section having hinged portions; and at least two arm sections housing a folded dipole conductor, said arm sections hingedly attached to said body section at said hinged portions, said folded dipole conductor electrically connected to said electronic components, said arm sections disposed on opposite sides of said body section, wherein each of said hinged portions includes a hub fixedly attached to said body section and a bore formed in each of said arm sections, said hub disposed in said bore, wherein said arm sections pivot about said hinged portions and are movable between a first position in which said arm sections extend from said body section in substantially opposite directions to a second position in which said arm sections extend from said body section in substantially the same direction, and wherein said hinged portions further comprise locking means for locking respective said arm sections in said first and second positions, said locking means comprising at least one indentation formed in one of said hub and an inler wall of each of said bores; and at least two protuberances formed on the other of said hub and said inner wall of each of said bores, said indentation selectively engageable with said protuberances, wherein when a first protuberance is engaged in said indentation, said arm section is secured in said first position, and when a second protuberance is engaged in said indentation, said arm section is secured in said second position.

* * * * *